United States Patent [19]

Kuhn

[11] 4,175,420

[45] Nov. 27, 1979

[54] SAFETY TIE DOWN FOR A PULLING APPARATUS

[76] Inventor: Charles J. Kuhn, 10520 Plainview Ave., Tujunga, Calif. 91042

[21] Appl. No.: 889,299

[22] Filed: Mar. 23, 1978

[51] Int. Cl.[2] ..... B21D 1/12

[52] U.S. Cl. ..... 72/447; 72/705

[58] Field of Search ..... 72/705, 457, 447

[56] References Cited

U.S. PATENT DOCUMENTS

| | | | |
|---|---|---|---|
| 3,492,855 | 2/1970 | Wylie | 72/705 |
| 3,566,666 | 3/1971 | Berendt et al. | 72/705 |
| 3,566,667 | 3/1971 | Hagerty | 72/705 |
| 3,589,680 | 6/1971 | Kuhn | 72/705 |
| 3,612,482 | 10/1971 | Eck | 72/705 |
| 3,817,081 | 6/1974 | Morski | 72/705 |

FOREIGN PATENT DOCUMENTS

| | | | |
|---|---|---|---|
| 463561 | 7/1975 | Australia | 72/705 |
| 1443382 | 7/1976 | United Kingdom | 72/705 |

*Primary Examiner*—Francis S. Husar
*Assistant Examiner*—D. M. Gurley
*Attorney, Agent, or Firm*—Harness, Dickey & Pierce

[57] ABSTRACT

There is disclosed herein a safety tie down assembly particularly adapted for use with pulling apparatus of the type employed in the repair of collision damage to motor vehicles. The safety tie down assembly comprises a pair of attachment members fixedly secured to outwardly facing surfaces of the spaced vertically extending members of the pulling apparatus. Chains or the like are attached to each of the attachment members and are designed to be secured to anchors when the pulling apparatus is being operated so as to restrain or limit movement of the pulling apparatus should the primary anchoring assembly break or otherwise let loose.

10 Claims, 5 Drawing Figures

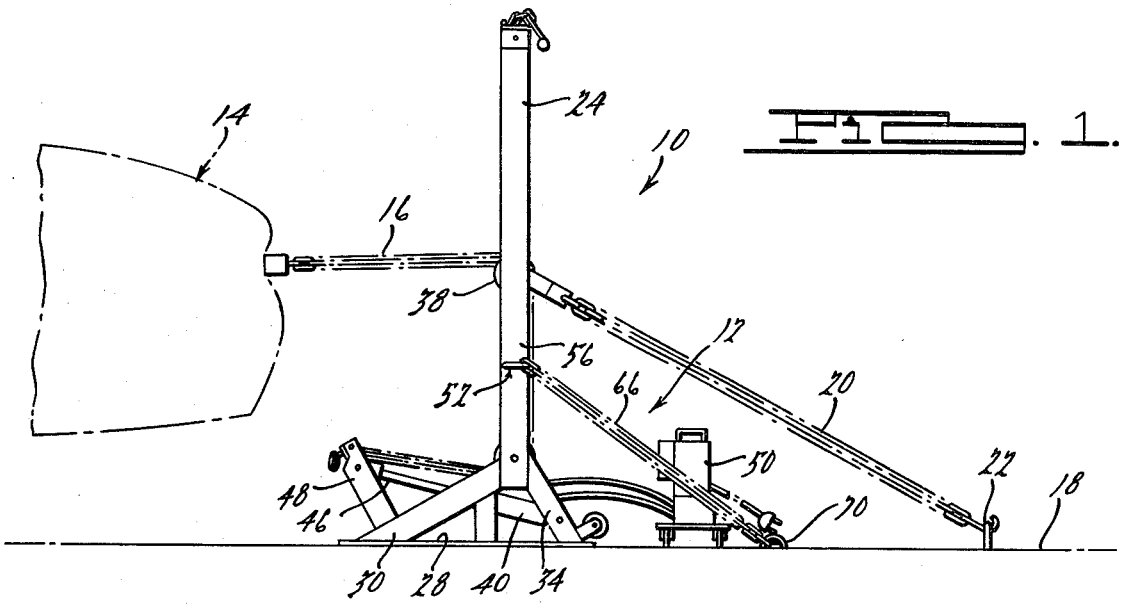
FIG. 1.
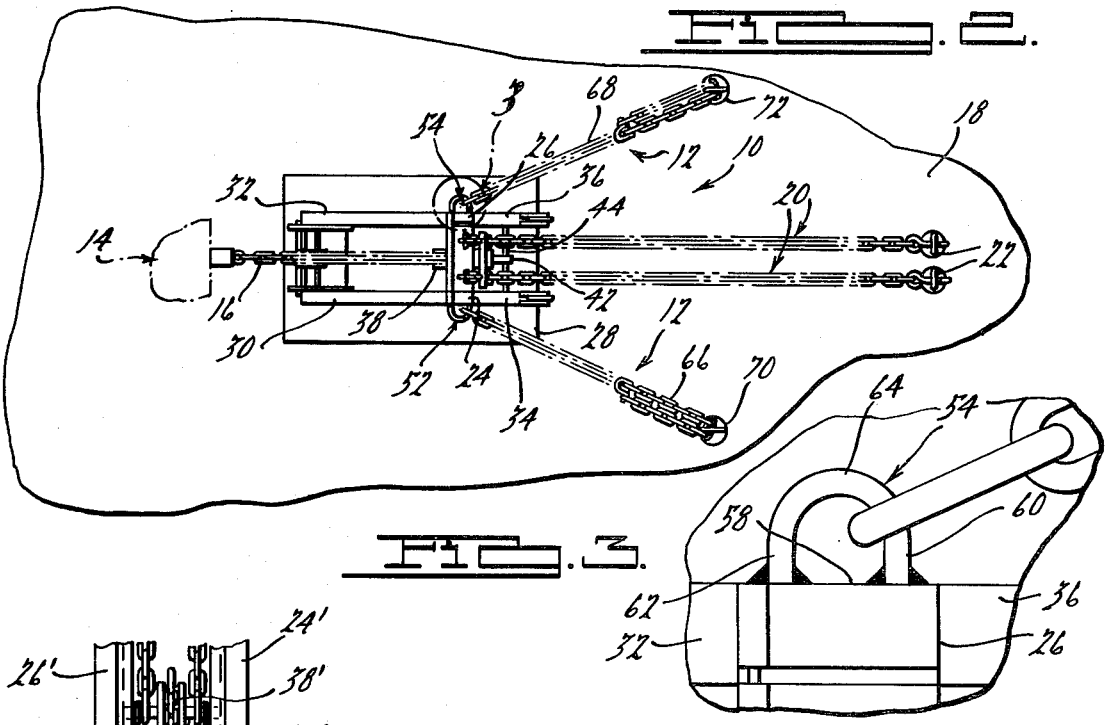
FIG. 2.
FIG. 3.
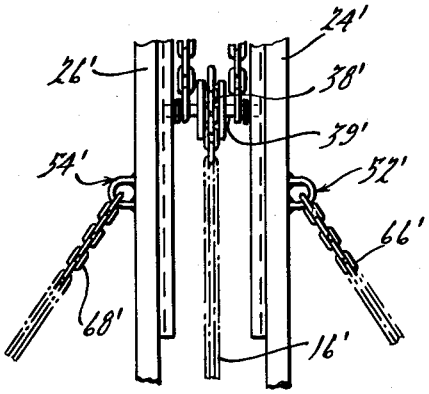
FIG. 4.
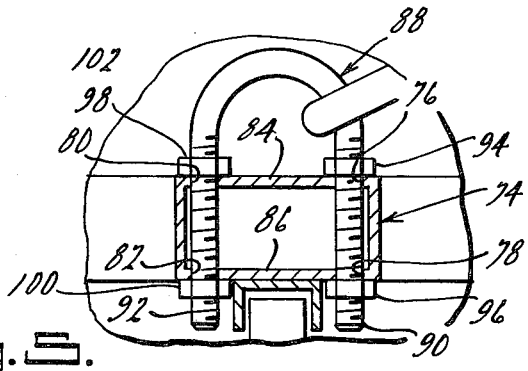
FIG. 5.

SAFETY TIE DOWN FOR A PULLING APPARATUS

BACKGROUND AND SUMMARY OF THE INVENTION

The present invention relates generally to pulling apparatus and more specifically to a safety tie down assembly for use with such pulling apparatus employed in conjunction with the repair of collision damage to motor vehicles.

Various types of pulling apparatus have long been in use in connection with straightening motor vehicle frames and other various body components. Generally, such apparatus comprises one or more vertically elongated support members having a plurality of longitudinally spaced holes provided therein. A shaft may be inserted through such holes to variably position guide means such as a pulley through which a chain may be lead and one end thereof attached to an appropriate portion of a motor vehicle. In another type of pulling apparatus, the guide means are movably supported by a pair of chains depending from an upper cross member. Tensioning means generally in the form of a hydraulically actuated piston is operatively associated with the apparatus and arranged so that the other end of the chain connected to the motor vehicle may be connected thereto so as to exert a pulling force upon the motor vehicle.

In use, such apparatus is generally supported on the floor and is provided with a primary anchoring assembly comprising a rearwardly extending chain or the like secured to a suitably positioned anchor so as to counteract the pulling force exerted by the hydraulic piston. Thus, the pulling apparatus is securely held in place so long as the rearwardly extending chain or line and associated anchor remain firmly secured. However, should this chain or line become detached from the anchor or the anchor otherwise let loose during a pulling operation, the sudden release thereof may cause the pulling apparatus to move toward the vehicle in a violent manner. Further, as such equipment is often subjected to rugged use or even occasional misuse and suitable inspection practices may not be adhered to, the anchoring chain may become worn, fatigued, or otherwise weakened so as to break under stress of a pulling operation thereby also allowing the pulling apparatus to jump backwards.

The present invention, however, provides a solution to this potential problem by providing suitable attachment members on the pulling apparatus to which chains, cables or the like may be attached. The other ends of the chains or cables may then be attached to any suitable anchoring means such as may be provided in the floor adjacent thereto. Thus, the present invention provides safety tie downs which will operate to restrain or otherwise limit movement of the pulling apparatus should an equipment failure occur.

Other objects, features and advantages of the present invention will become apparent from the subsequent description and the appended claims, taken in conjunction with the accompanying drawings, which set forth by way of illustration and example the preferred embodiments of the present invention.

BRIEF DESCRIPTION OF THE DRAWINGS

FIG. 1 is a side elevational view of a pulling apparatus employing the safety tie down assembly of the present invention and shown in operative relationship to a motor vehicle;

FIG. 2 is a top view of the pulling apparatus and associated tie down assembly illustrated in FIG. 1;

FIG. 3 is an enlarged fragmentary detail view of a portion of the pulling apparatus lying within circle 3 of FIG. 2;

FIG. 4 is a fragmentary front elevational view of another embodiment of the present invention; and FIG. 5 is a fragmentary plan view illustrating another embodiment of the present invention.

DESCRIPTION OF THE PREFERRED EMBODIMENTS

Referring now to the drawings and in particular to FIGS. 1 and 2, there is shown a pulling apparatus 10 having a safety tie down assembly 12 is accordance with the present invention illustrated in operative relationship to exert a pulling force upon motor vehicle 14 through flexible connecting member 16 extending therebetween. As shown therein, pulling apparatus 10 is supported upon a generally horizontal surface 18 such as a floor or the like and has primary anchor means comprising one or more chains, cables or the like 20 connected to a suitable anchor 22 or the like embedded or otherwise secured to surface 18 so as to counteract the pulling force exerted on motor vehicle 14.

As best seen with reference to FIGS. 1 and 2, pulling apparatus 10 may be of the type disclosed in my copending application Ser. No. 861,200 filed 12/16/77 and entitled "Pulling Apparatus," the disclosure of which is incorporated herein by reference or of any other conventional type. Pulling apparatus 10 comprises a pair of spaced substantially parallel vertically extending members 24 and 26 each of which are rigidly supported upon a base member 28 by a pair of depending diverging elongated support members 30, 32, 34, and 36. As shown, vertical members 24 and 26 are hollow and have a generally rectangular cross-section although it should be noted that they may have any other desired cross-sectional shape. A guide member preferably in the form of a pulley 38 is rotatably supported on a shaft 39 extending between vertical members 24 and 26 and through which flexible connecting member 16 extends. Preferably flexible connector 16 will be in the form of a chain although a suitable sized cable may also be used.

In order to exert a pulling action on chain 16, a hydraulic power cylinder 40 is provided having one end 42 pivotably connected between support members 34 and 36 via pin 44 and another end 46 pivotably connected to pivot arm 48 adjacent the upper end thereof. A suitable power source 50 may be connected to power cylinder 40 to control operation thereof.

As best seen with reference to FIGS. 1 through 3, safety tie down assembly 12 comprises first and second attachment members 52 and 54 secured to oppositely outwardly facing surfaces 56 and 58 of vertical members 24 and 26 respectively. Attachment members 52 and 54 are substantially identical and therefore only member 54 will be described in detail. As best seen in FIG. 3, attachment member 54 is of a generally U-shaped configuration having substantially parallel coplanar spaced leg portions 60 and 62 each of which is preferably secured to surface 58 of vertical member 26 by welding and an arcuate shaped interconnecting portion 64.

A pair of flexible connecting members 66 and 68 are also provided preferably in the form of chains although suitable wire rope or the like may be substituted therefor. One end of each of chains 66 and 68 are connected to respective of attachment members 52 and 54 and are of sufficient length to enable the opposite ends thereof to be secured to suitable anchor means such as floor anchors 70 and 72. Preferably, anchors 70 and 72 will be spaced a substantial distance apart and behind pulling apparatus 10, pulling apparatus 10 being positioned substantially along a line lying perpendicular to a line extending between anchors 70 and 72. This configuration thereby enables chains 66 and 68 to provide lateral stability to pulling apparatus 10 as well as providing a safety back up tie down to the primary anchoring assembly so as to limit or restrain forward movement thereof.

It should be noted that while attachment members 52 and 54 have been described as being in the form of generally U-shaped members, other suitable attachment means may be easily substituted therefor such as a circular ring, tang, conventional shackle or the like. Further, while FIGS. 1 through 3 illustrate attaching members 52 and 54 as lying in a substantially horizontal plane, it may be desirable to position the attaching members within a vertical plane of orientation as is illustrated in FIG. 4 in which corresponding portions are indicated by like numerals primed. As the only variation between the structure of FIG. 4 and that of FIGS. 1–3 is the orientation of the attaching members, further description thereof is believed unnecessary.

Referring now to FIG. 5, there is illustrated an alternative means for securing the attachment members to the vertically extending members. In this embodiment, vertical member 74, corresponding to and substantially identical to vertical member 26, is provided with two pairs of aligned spaced openings 76, 78, 80, and 82 extending through walls 84 and 86 respectively thereof. Attachment member 88 also is generally U-shaped having elongated threaded spaced leg portions 90 and 92 which extend through openings 76, 78 and 80, 82 respectively. FIG. 90 has a first nut 94 provided thereon which engages wall 84 and a second nut 96 provided thereon which engages wall 86 so as to thereby exert a clamping action on vertical member 74. Similarly, leg 92 is provided with nuts 98 and 100 also clamping vertical member 74 therebetween and cooperating with nuts 94 and 96 to secure attachment member 88 to vertical member 74. A suitable chain or the like 102 may be connected to attachment member 88 in any convenient manner such as by a suitable shackle or the like. Also, a second attachment member may be secured in like manner to the other vertical member.

In order to operate the pulling apparatus utilizing the safety tie down assembly of the present invention, the pulling apparatus 10 is first suitably positioned with respect to vehicle 14 and floor anchors 70, 72, and 22. Thereafter, chain 16 is connected to vehicle 14, chains 20 are attached to anchors 22 and chains 66 and 68 are connected to anchors 70 and 72 respectively in downwardly extending outwardly diverging relationship. Thereafter, pulley 38 may be adjusted to a suitable height to provide the proper pulling angle and power supply 50 actuated to operate piston 40 which in turn will exert a pulling force upon vehicle 14 via chain 16. In the event that chain 20 should break or become detached from anchor 22, or anchor 22 should become detached from surface 18, safety tie down chains 66 and 68 will operate to restrain pulling apparatus 10 from jumping forward toward vehicle 14. Further, as chains 66 and 68 are arranged in an outwardly diverging relationship to pulling apparatus 10, they will also provide lateral stability so as to prevent pulling apparatus 10 from tilting during a pulling operation should pulling apparatus be positioned out of alignment with respect to the primary anchor assembly and chain 16.

While the above description constitutes the preferred embodiments of the invention, it will be appreciated that the invention is susceptible to modification, variation and change without departing from the proper scope or fair meaning of the accompanying claims.

I claim:

1. In a pulling apparatus comprising a pair of spaced vertically extending members having oppositely outwardly facing surfaces, support means supporting said vertically extending members, guide means movably supported between said vertically extending members, pulling means supported on said support means, and flexible connecting means having one end connected to said pulling means extending through said guide means and having the other end adapted to be connected to a workpiece, primary anchor means including at least one flexible connecting means having one end secured to said pulling apparatus, a safety tie down assembly comprising attachment means secured to one of said outwardly facing surfaces of said vertically extending members intermediate the ends thereof, second flexible connecting means having one end secured to said attachment means, said primary anchor means being adapted to be secured to first anchor means and the other end of said second flexible connecting means being adapted to be secured to second anchor means so as to restrain movement of said pulling apparatus along the line in which said pulling force is directed.

2. A safety tie down assembly for a pulling apparatus as set forth in claim 1 wherein said attachment means comprises first and second members secured to respective of said outwardly facing surfaces.

3. A safety tie down assembly for a pulling apparatus as set forth in claim 2 wherein said first and second members are generally U-shaped.

4. A safety tie down assembly for a pulling apparatus as set forth in claim 2 wherein said first and second members are secured to said surfaces by welding.

5. A safety tie down assembly for a pulling apparatus as set forth in claim 3 wherein said first and second members are disposed in a vertically extending plane.

6. A safety tie down assembly for a pulling apparatus as set forth in claim 3 wherein said first and second members are disposed in a horizontally extending plane.

7. A safety tie down assembly for a pulling apparatus as set forth in claim 3 wherein said first and second members each have threaded end portions, each of said end portions being received in openings provided in said vertically extending members and a pair of nuts threadedly engaging each of said end portions so as to clamp a portion of said vertical member therebetween.

8. A safety tie down assembly for a pulling apparatus as set forth in claim 1 wherein said attachment means is secured to said outwardly facing surface below said at least one flexible connecting means.

9. A safety tie down assembly for a pulling apparatus as set forth in claim 1 further comprising second attachment means secured to the other of said outwardly facing surfaces and third flexible connecting means having one end secured to said second attachment means, the other end of said third flexible connecting means being adapted to be secured to anchor means so as to restrain movement of said pulling apparatus.

10. A safety tie down assembly for a pulling apparatus as set forth in claim 9 wherein said third flexible connecting means is adapted to be secured to third anchor means, said second and said third anchor means being laterally spaced along a line lying generally perpendicular to the line in which said pulling force is directed.

* * * * *